US011857888B1

(12) United States Patent
Chasteen

(10) Patent No.: US 11,857,888 B1
(45) Date of Patent: Jan. 2, 2024

(54) TOY GAS STATION PLAYSET

(71) Applicant: Sherry Chasteen, Franklin, OH (US)

(72) Inventor: Sherry Chasteen, Franklin, OH (US)

( * ) Notice: Subject to any disclaimer, the term of this patent is extended or adjusted under 35 U.S.C. 154(b) by 415 days.

(21) Appl. No.: 17/202,472

(22) Filed: Mar. 16, 2021

(51) Int. Cl.
*A63H 17/44* (2006.01)
*A63H 3/52* (2022.01)

(52) U.S. Cl.
CPC ..... *A63H 17/44* (2013.01); *A63H 3/52* (2013.01)

(58) Field of Classification Search
CPC ..... A63H 3/52; A63H 17/44
See application file for complete search history.

(56) References Cited

U.S. PATENT DOCUMENTS 1,258,788 A 3/1918 Koch
3,483,653 A * 12/1969 Robert ..... A63H 17/44 446/423
3,653,146 A * 4/1972 Goldfarb ..... A63H 17/44 446/423
4,349,983 A 9/1982 Kilroy
4,508,519 A 4/1985 Becker
4,734,076 A * 3/1988 Goldstein ..... A63H 17/44 446/423
5,112,263 A 5/1992 Penillard
5,177,913 A * 1/1993 Erel ..... E04H 6/10 52/236.7
D366,290 S * 1/1996 Dieudonne ..... E04H 6/10 D21/509
6,572,436 B1 * 6/2003 So ..... A63H 17/44 446/478
8,298,038 B2 10/2012 O'Connor
D682,951 S 5/2013 Sandhei
8,888,554 B2 11/2014 Finizza

FOREIGN PATENT DOCUMENTS

GB 2113108 8/1983

* cited by examiner

*Primary Examiner* — John A Ricci
(74) *Attorney, Agent, or Firm* — Kyle A. Fletcher, Esq.

(57) ABSTRACT

The toy gas station playset is configured for use as an amusement. The toy gas station playset present figurines and puppets that are used to emulate the activities of a vehicle park. The emulated activities include, but are not limited to the parking and refueling of a vehicle. The toy gas station playset forms a bi-level structure within which the emulated activities are performed. The toy gas station playset comprises a pedestal structure, a plurality of stanchions, and an elevated platform structure. The plurality of stanchions elevates the elevated platform structure above the pedestal structure.

18 Claims, 5 Drawing Sheets

TOY GAS STATION PLAYSET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of games and amusements, more specifically, other toys. (A63H33/00)

SUMMARY OF INVENTION

The toy gas station playset is configured for use as an amusement. The toy gas station playset present figurines and puppets that are used to emulate the activities of a vehicle park. The emulated activities include, but are not limited to, the parking and refueling of a vehicle. The toy gas station playset forms a bi-level structure within which the emulated activities are performed. The toy gas station playset comprises a pedestal structure, a plurality of stanchions, and an elevated platform structure. The plurality of stanchions elevates the elevated platform structure above the pedestal structure.

These together with additional objects, features and advantages of the toy gas station playset will be readily apparent to those of ordinary skill in the art upon reading the following detailed description of the presently preferred, but nonetheless illustrative, embodiments when taken in conjunction with the accompanying drawings.

In this respect, before explaining the current embodiments of the toy gas station playset in detail, it is to be understood that the toy gas station playset is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toy gas station playset.

It is therefore important that the claims be regarded as including such equivalent construction insofar as they do not depart from the spirit and scope of the toy gas station playset. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
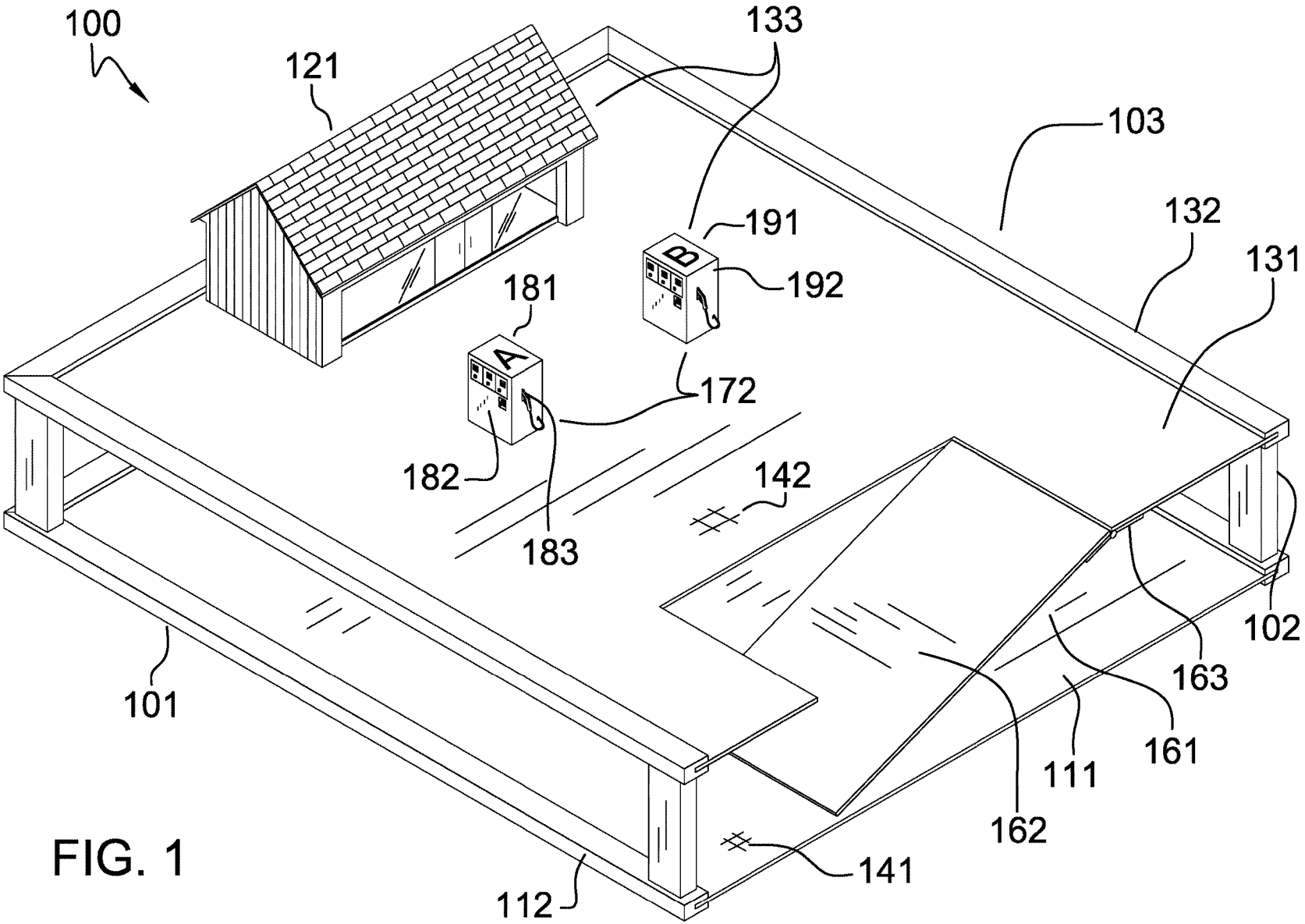
FIG. 1 is a perspective view of an embodiment of the disclosure.
Figure 2:
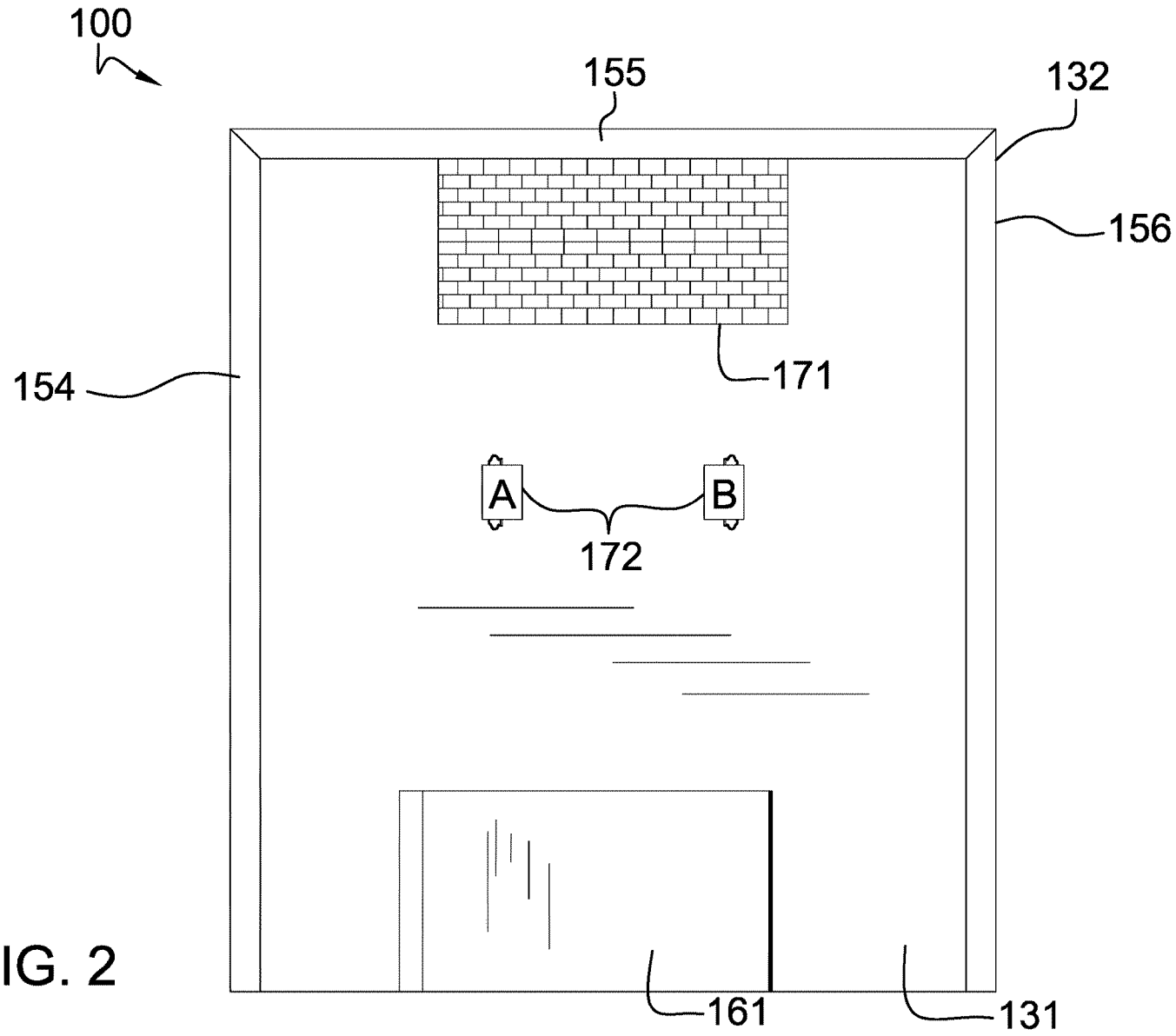
FIG. 2 is a top view of an embodiment of the disclosure.
Figure 4:
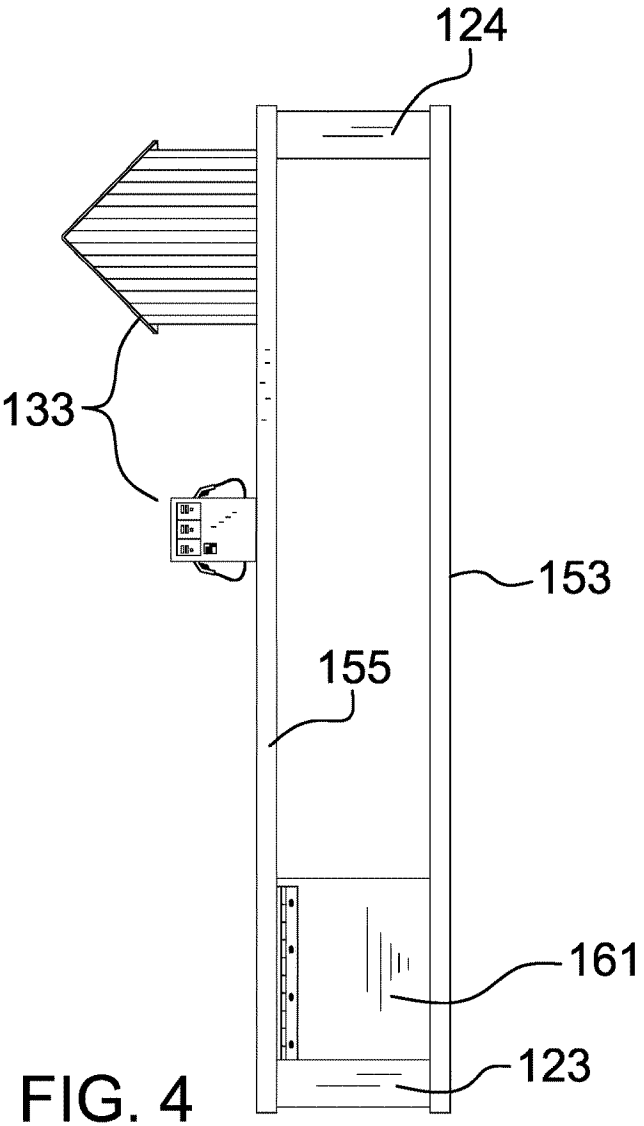
FIG. 4 is a reverse side view of an embodiment of the disclosure.
Figure 3:
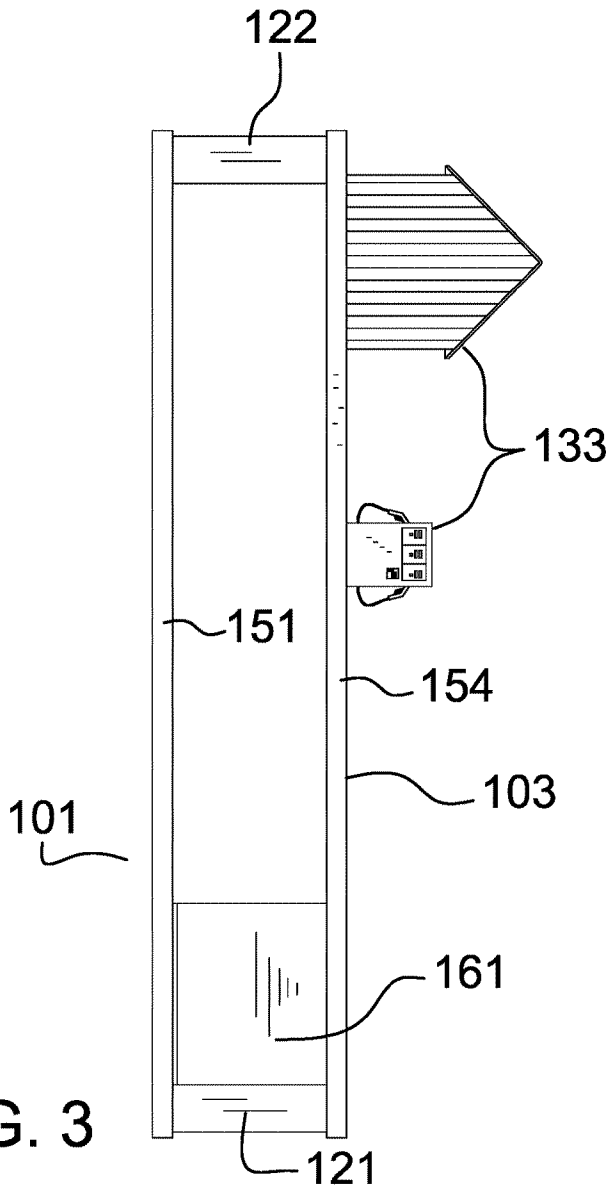
FIG. 3 is a side view of an embodiment of the disclosure.
Figure 5:
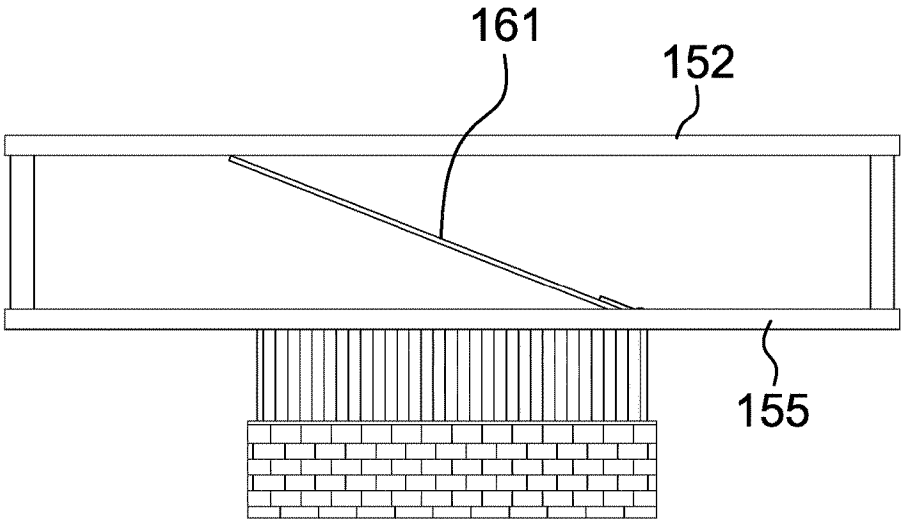
FIG. 5 is a rear view of an embodiment of the disclosure.
Figure 6:
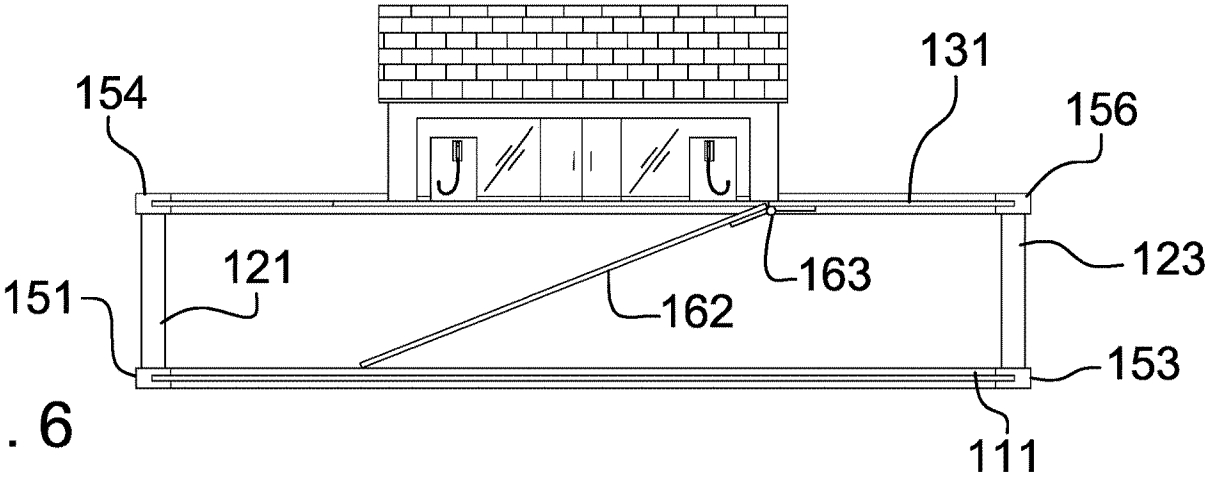
FIG. 6 is a front view of an embodiment of the disclosure.
Figure 7:
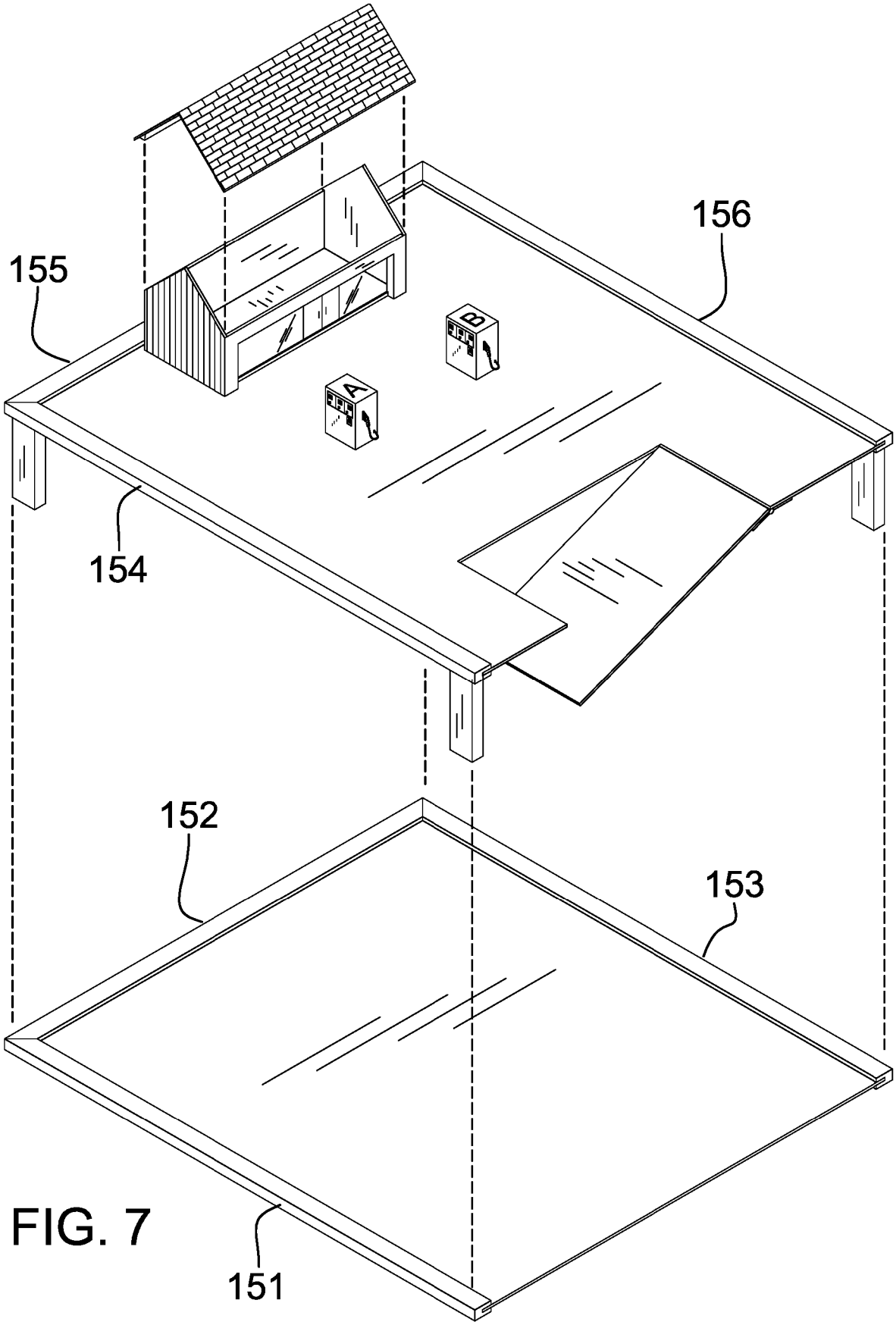
FIG. 7 is an exploded view of an embodiment of the disclosure.

Detailed reference will now be made to one or more potential embodiments of the disclosure, which are illustrated in FIGS. 1 through 7.

The toy gas station playset 100 (hereinafter invention) is configured for use as an amusement. The invention 100 present figurines and puppets that are used to emulate the activities of a vehicle park. The emulated activities include, but are not limited to the parking and refueling of a vehicle. The invention 100 forms a bi-level structure within which the emulated activities are performed. The invention 100 comprises a pedestal structure 101, a plurality of stanchions 102, and an elevated platform structure 103. The plurality of stanchions 102 elevates the elevated platform structure 103 above the pedestal structure 101.

The pedestal structure 101 is a pedestal. The pedestal is defined elsewhere in this disclosure. The pedestal structure 101 transfers the loads of the plurality of stanchions 102 and the elevated platform structure 103 to a supporting surface. The pedestal structure 101 forms a horizontally oriented surface that receives the figurines and puppets during play activity. The pedestal structure 101 comprises a pedestal plate 111 and a first plurality of c-channels 112.

The pedestal plate 111 is a prism-shaped structure. The pedestal plate 111 is a disk-shaped structure. A congruent end of the disk structure of the pedestal plate 111 forms the horizontally oriented surface that receives the figurines and puppets during play activity. The first plurality of c-channels 112 elevates the pedestal plate 111 above the supporting surface. The pedestal plate 111 further comprises a pedestal chalkboard surface 141.

The pedestal chalkboard surface 141 is a whiteboard structure formed on the superior surface of the congruent end of the pedestal plate 111 of the pedestal structure 101. The pedestal chalkboard surface 141 forms a surface that allows drawing lines that emulate the images commonly used to control vehicle traffic. The pedestal chalkboard surface 141 is an erasable structure. In the first potential embodiment of the disclosure the pedestal chalkboard surface 141 is applied to the pedestal plate 111 as a coating of chalkboard paint.

The first plurality of c-channels 112 forms the final link of the load path that transfers the load of the invention 100 to the supporting surface. Each of the first plurality of c-channels 112 is a prism-shaped structure. Each of the first plurality of c-channels 112 is formed with a slot. The slot of each c-channel selected from the first plurality of c-channels 112 runs parallel to the center axis of the prism structure of the selected c-channel. The span of the length of the inner dimension of the slot of each c-channel selected from the first plurality of c-channels 112 is greater than the span of the length of the thickness of the pedestal plate 111 such that the pedestal plate 111 will insert into the slot of the selected c-channel.

The center dimension of each c-channel selected from the first plurality of c-channels 112 is greater than a dimension selected from the group consisting of: a) the major dimension of the pedestal plate 111; and, b) the minor dimension of the pedestal plate 111. The first plurality of c-channels 112 attach to the pedestal plate 111 to form a u-shaped structure.

The first plurality of c-channels 112 comprises a first c-channel 151, a second c-channel 152, and a third c-channel 153.

The first c-channel 151 is a prism-shaped structure. The first c-channel 151 forms the first arm of the u-shaped structure formed by the first plurality of c-channels 112. The first c-channel 151 forms a c-channel. The first c-channel 151 is formed with a slot. The slot of the first c-channel 151 runs parallel to the center axis of the prism structure of the first c-channel 151. The span of the length of the inner dimension of the slot of the first c-channel 151 is greater than the span of the length of the thickness of the pedestal plate 111 such that the pedestal plate 111 inserts into the slot of the first c-channel 151.

The second c-channel 152 is a prism-shaped structure. The second c-channel 152 forms the crossbeam of the u-shaped structure formed by the first plurality of c-channels 112. The second c-channel 152 forms a c-channel. The second c-channel 152 is formed with a slot. The slot the second c-channel 152 runs parallel to the center axis of the prism structure of the second c-channel 152. The span of the length of the inner dimension of the slot of the second c-channel 152 is greater than the span of the length of the thickness of the pedestal plate 111 such that the pedestal plate 111 inserts into the slot of the second c-channel 152.

The third c-channel 153 is a prism-shaped structure. The third c-channel 153 forms the second arm of the u-shaped structure formed by the first plurality of c-channels 112. The third c-channel 153 forms a c-channel. The third c-channel 153 is formed with a slot. The slot of the third c-channel 153 runs parallel to the center axis of the prism structure of the third c-channel 153. The span of the length of the inner dimension of the slot of the third c-channel 153 is greater than the span of the length of the thickness of the pedestal plate 111 such that the pedestal plate 111 inserts into the slot of the third c-channel 153.

The elevated platform structure 103 is a horizontally oriented platform. The elevated platform structure 103 forms a horizontally oriented surface that receives the figurines and puppets during play activity. The elevated platform structure 103 comprises a platform plate 131, a second plurality of c-channels 132, and a plurality of puppet structures 133.

The platform plate 131 is a prism-shaped structure. The platform plate 131 is a disk-shaped structure. A congruent end of the disk structure of the platform plate 131 forms the horizontally oriented surface that receives the figurines and puppets during play activity. In the first potential embodiment of the disclosure, the platform plate 131 is geometrically similar to the pedestal plate 111. The platform plate 131 further comprises a platform chalkboard surface 142 and a ramp structure 161.

The platform chalkboard surface 142 is a whiteboard structure formed on the superior surface of the congruent end of the platform plate 131 of the pedestal structure 101. The platform chalkboard surface 142 forms a surface that allows drawing lines that emulate the images commonly used to control vehicle traffic. The platform chalkboard surface 142 is an erasable structure. In the first potential embodiment of the disclosure the platform chalkboard surface 142 is applied to the platform plate 131 as a coating of chalkboard paint.

The ramp structure 161 is a ramp. The ramp structure 161 is an inclined surface that joins the pedestal plate 111 with the platform plate 131 such that the invention 100 can emulate the transfer of a vehicle between the pedestal structure 101 and the elevated platform structure 103. The ramp structure 161 further comprises a cutout plate 162 and a hinge 163.

The cutout plate 162 is a disk-shaped structure that is cut out of the platform plate 131 of the elevated platform structure 103. The hinge 163 is a fastening structure. The hinge 163 secures the cutout plate 162 to the platform plate 131 such that the cutout plate 162 rotates relative to the platform plate 131. The hinge 163 allows for the adjustment of the position of the cutout plate 162 such that the cutout plate 162 forms the inclined surface of the ramp structure 161. The position of the cutout plate 162 is formed in the edge of the platform plate 131 that is distal from the fifth c-channel 155 such that the ramp structure 161 is halfway between the fourth c-channel 154 and the sixth c-channel 156.

The second plurality of c-channels 132 attaches to the platform plate 131. The second plurality of c-channels 132 forms the portion of the load path that transfers the load of the elevated platform structure 103 to the plurality of stanchions 102. Each of the second plurality of c-channels 132 is a prism-shaped structure. Each of the second plurality of c-channels 132 is formed with a slot. The slot of each c-channel selected from the second plurality of c-channels 132 runs parallel to the center axis of the prism structure of the selected c-channel. The span of the length of the inner dimension of the slot of each c-channel selected from the second plurality of c-channels 132 is greater than the span of the length of the thickness of the platform plate 131 such that the platform plate 131 will insert into the slot of the selected c-channel.

The center dimension of each c-channel selected from the second plurality of c-channels 132 is greater that a dimension selected from the group consisting of: a) the major dimension of the platform plate 131; and, b) the minor dimension of the platform plate 131. The second plurality of c-channels 132 attach to the platform plate 131 to form a u-shaped structure.

The second plurality of c-channels 132 comprises a fourth c-channel 154, a fifth c-channel 155, and a sixth c-channel 156.

The fourth c-channel 154 is a prism-shaped structure. The fourth c-channel 154 forms the first arm of the u-shaped structure formed by the second plurality of c-channels 132. The fourth c-channel 154 forms a c-channel. The fourth c-channel 154 is formed with a slot. The slot of the fourth c-channel 154 runs parallel to the center axis of the prism structure of the fourth c-channel 154. The span of the length of the inner dimension of the fourth c-channel 154 is greater than the span of the length of the thickness of the platform plate 131 such that the platform plate 131 inserts into the slot of the fourth c-channel 154.

The fifth c-channel 155 is a prism-shaped structure. The fifth c-channel 155 forms the crossbeam of the u-shaped structure formed by the second plurality of c-channels 132. The fifth c-channel 155 forms a c-channel. The fifth c-channel 155 is formed with a slot. The slot of the fifth c-channel 155 runs parallel to the center axis of the prism structure of the fifth c-channel 155. The span of the length of the inner dimension of the slot of the fifth c-channel 155 is greater than the span of the length of the thickness of the platform plate 131 such that the platform plate 131 inserts into the slot of the fifth c-channel 155.

The sixth c-channel 156 is a prism-shaped structure. The sixth c-channel 156 forms the second arm of the u-shaped structure formed by the second plurality of c-channels 132. The sixth c-channel 156 forms a c-channel. The sixth c-channel 156 is formed with a slot. The slot of the sixth c-channel 156 runs parallel to the center axis of the prism structure of the sixth c-channel 156. The span of the length of the inner dimension of the slot of the sixth c-channel 156 is greater than the span of the length of the thickness of the platform plate 131 such that the platform plate 131 inserts into the slot of the sixth c-channel 156.

Each of the plurality of puppet structures 133 are physical models of structure that are used to emulate the activities of a vehicle park. The plurality of puppet structures 133 comprises a storefront 171 and a plurality of pumps 172.

The storefront 171 is a figurine. The storefront 171 has the shape of a building such that the storefront 171 emulates a retail establishment commonly referred to as a gas station. The applicant intends that the storefront 171 rests on the superior congruent end of the disk structure of the platform plate 131.

Each of the plurality of pumps 172 is a puppet. Each of the plurality of pumps 172 has the appearance of a structure such that the plurality of pumps 172 emulates a mechanical device known as a gas pump. The applicant intends that the plurality of pumps 172 rests on the superior congruent end of the disk structure of the platform plate 131. The plurality of pumps 172 comprises a first pump 181 and a second pump 191.

The first pump 181 further comprises a first reservoir 182 and a first nozzle 183. The second pump 191 further comprises a second reservoir 192 and a second nozzle 193.

The plurality of stanchions 102 combine to attach the elevated platform structure 103 to the pedestal structure 101. Each of the plurality of stanchions 102 forms a load bearing structure. Each of the plurality of stanchions 102 forms a vertically oriented structure. The plurality of stanchions 102 elevates the elevated platform structure 103 above the pedestal structure 101 such that the elevated platform structure 103 forms the superior structure of the invention 100. Each of the plurality of stanchions 102 forms a load path that transfers a portion of the load of the elevated platform structure 103 to the pedestal structure 101. The plurality of stanchions 102 comprises a first stanchion 121, a second stanchion 122, a third stanchion 123, and a fourth stanchion 124.

The first stanchion 121 is a prism-shaped structure. The first stanchion 121 is a vertically oriented structure. By vertically oriented is meant that the center axis of the prism structure of the first stanchion 121 is aligned with the force of gravity. The first stanchion 121 forms a portion of the load path the transfers the load of the elevated platform structure 103 to the pedestal structure 101. The first stanchion 121 attaches to the lateral face of the prism structure of the first c-channel 151. The position of the first stanchion 121 is such that the span of the distance from the first stanchion 121 to the free end of the first c-channel 151 is less than the span of the distance from the first stanchion 121 to the fixed end of the first c-channel 151. The first stanchion 121 projects away from the center axis of the prism structure of the first c-channel 151 in the superior direction.

The second stanchion 122 is a prism-shaped structure. The second stanchion 122 is a vertically oriented structure. By vertically oriented is meant that the center axis of the prism structure of the second stanchion 122 is aligned with the force of gravity. The second stanchion 122 forms a portion of the load path that transfers the load of the elevated platform structure 103 to the pedestal structure 101. The second stanchion 122 attaches to the lateral face of the prism structure of the first c-channel 151. The position of the second stanchion 122 is such that the span of the distance from the second stanchion 122 to the fixed end of the first c-channel 151 is less than the span of the distance from the second stanchion 122 to the free end of the first c-channel 151. The second stanchion 122 projects away from the center axis of the prism structure of the first c-channel 151 in the superior direction.

The fourth stanchion 124 is a prism-shaped structure. The fourth stanchion 124 is a vertically oriented structure. By vertically oriented is meant that the center axis of the prism structure of the fourth stanchion 124 is aligned with the force of gravity. The fourth stanchion 124 forms a portion of the load path that transfers the load of the elevated platform structure 103 to the pedestal structure 101. The fourth stanchion 124 attaches to the lateral face of the prism structure of the third stanchion 123. The position of the fourth stanchion 124 is such that the span of the distance from the fourth stanchion 124 to the free end of the third stanchion 123 is less than the span of the distance from the fourth stanchion 124 to the fixed end of the third stanchion 123. The fourth stanchion 124 projects away from the center axis of the prism structure of the third stanchion 123 in the superior direction.

The third stanchion 123 is a prism-shaped structure. The third stanchion 123 is a vertically oriented structure. By vertically oriented is meant that the center axis of the prism structure of the third stanchion 123 is aligned with the force of gravity. The third stanchion 123 forms a portion of the load path that transfers the load of the elevated platform structure 103 to the pedestal structure 101. The third stanchion 123 attaches to the lateral face of the prism structure of the second c-channel 152. The position of the third stanchion 123 is such that the span of the distance from the third stanchion 123 to the fixed end of the second c-channel 152 is less than the span of the distance from the third stanchion 123 to the free end of the second c-channel 152. The third stanchion 123 projects away from the center axis of the prism structure of the second c-channel 152 in the superior direction.

The first stanchion 121 removably attaches to the lateral face of the prism structure of the fourth c-channel 154. The position of the first stanchion 121 is such that the span of the distance from the first stanchion 121 to the free end of the fourth c-channel 154 is less than the span of the distance from the first stanchion 121 to the fixed end of the fourth c-channel 154. The first stanchion 121 projects away from the center axis of the prism structure of the fourth c-channel 154 in the inferior direction.

The second stanchion 122 removably attaches to the lateral face of the prism structure of the fourth c-channel 154. The position of the second stanchion 122 is such that the span of the distance from the second stanchion 122 to the fixed end of the fourth c-channel 154 is less than the span of the distance from the second stanchion 122 to the free end of the fourth c-channel 154. The second stanchion 122 projects away from the center axis of the prism structure of the fourth c-channel 154 in the inferior direction.

The fourth stanchion 124 removably attaches to the lateral face of the prism structure of the sixth c-channel 156. The position of the fourth stanchion 124 is such that the span of the distance from the fourth stanchion 124 to the free end of the sixth c-channel 156 is less than the span of the distance from the fourth stanchion 124 to the fixed end of the sixth c-channel 156. The fourth stanchion 124 projects away from the center axis of the prism structure of the sixth c-channel 156 in the inferior direction.

The third stanchion 123 removably attaches to the lateral face of the prism structure of the sixth c-channel 156. The position of the third stanchion 123 is such that the span of the distance from the third stanchion 123 to the fixed end of the sixth c-channel 156 is less than the span of the distance from the third stanchion 123 to the free end of the sixth c-channel 156. The third stanchion 123 projects away from the center axis of the prism structure of the sixth c-channel 156 in the inferior direction.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

C-Channel: As used in this disclosure, the C-channel is a structure that is formed in a U-shape. The C-channel forms a prism shape with a hollow interior and an open lateral face that forms a shape characteristic of the letter C when viewed from the congruent ends. The open space of the C-channel is often used as a track. A C-channel is a U-shaped structure.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center, Major, Minor, and Thickness Dimensions: As used in this disclosure, the center dimension, the major dimension, the minor dimension, and the thickness each refer to the span of a length associated with a structure selected from the group consisting of a prism structure and a disk structure. The center dimension is the span of the length of the center axis of the selected structure. The thickness is an alternate name given to the center dimension when the selected structure is a disk structure. The major dimension is the span of the length of the major axis of the perimetrical boundary that contains the selected structure. The minor dimension is the span of the length of the minor axis of the perimetrical boundary that contains the selected structure. The terms center dimension, the major dimension, the minor dimension, and the thickness are also used to describe one or more linear axes of direction associated with the selected structure.

Chalk: As used in this disclosure, chalk is a material made primarily of calcium carbonate that is used for marking on chalkboards (blackboards) or other surfaces Coating: As used in this disclosure, a coating refers to a substance that is applied to the exterior surface of an object such that the coating forms a new exterior surface of the object. A coating is commonly said to be formed as a layer. Paint is an example of a common coating material.

Cutout: As used in this disclosure, a cutout refers to a first disk-shaped structure that is "cutout" of a second disk-shaped structure such that a negative space is formed in the second disk-shaped structure. The form factor of the negative space formed in the second disk-shaped structure is geometrically similar to the first disk-shaped structure such that the first disk-shaped structure can be inserted into the negative space of the second disk-shaped structure to form a "continuous disk" structure.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Figurine: As used in this disclosure, a figurine is a three dimensional structure resembling a human, animal or symbolic image.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Major and Minor Axes: As used in this disclosure, the major and minor axes refer to a pair of perpendicular axes that are defined within a structure. The length of the major axis is always greater than or equal to the length of the minor axis. The major axis forms the longest symmetric bifurcation of the structure. The major and minor axes intersect at the center of the structure. The major axis is always parallel or perpendicular to an edge of a rectangular or rectilinear structure.

Negative Space: As used in this disclosure, negative space is a method of defining an object through the use of open or empty space as the definition of the object itself, or, through the use of open or empty space to describe the boundaries of an object.

Paint: As used in this disclosure, when used as a noun the term paint refers to a pigment based colloid or solution that is applied to a surface as a coating of the surface. When used as a verb, the term paint refers to the application of paint to a surface.

Pedestal: As used in this disclosure, a pedestal is an intermediary load bearing structure that that forms a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object. In a two-dimensional structure, the perimetrical boundary is the rectangle with the minimum surface area.

Pivot: As used in this disclosure, a pivot is a rod or shaft around which an object rotates or swings.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Puppet: As used in this disclosure, a puppet is a three-dimensional figure resembling a human, animal or symbolic image that is used for entertainment or educational purposes.

Ramp: As used in this disclosure, a ramp is an inclined surface that joins two parallel surfaces that are: 1) of different elevations; or 2) not aligned on the same plane.

Rectangular Block: As used in this disclosure, a rectangular block refers to a three-dimensional prism structure comprising six rectangular surfaces (commonly called faces) formed at right angles. Within this disclosure, a rectangular block may further comprise rounded edges and corners.

Ridge: As used in this disclosure, a ridge is a rectangular block structure attaches to and projects vertically away from a first surface.

Rim: As used in this disclosure, a rim is an outer edge or border that follows along the perimeter of an object.

Roof: As used in this disclosure, a roof is the exterior surface of a structure that is distal from the surface upon which the structure is placed. As used in this disclosure, the exterior surface is assumed to include the supporting structures associated with the exterior surface including, but not limited to, rafters, decking, soffits and fascia. A pitched roof is a roof wherein the surface of the roof has a cant that is not perpendicular to the direction of gravity.

Rounded: As used in this disclosure, the term rounded refers to the replacement of an apex, vertex, or edge or brink of a structure with a (generally smooth) curvature wherein the concave portion of the curvature faces the interior or center of the structure.

Slot: As used in this disclosure, a slot is a prism-shaped negative space formed as a groove or aperture that is formed in or through an object.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Stanchion: As used in this disclosure, a stanchion refers to a vertically oriented prism-shaped pole, post, or support.

U-Shaped Structure: As used in this disclosure, a U-shaped structure refers to a three-sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of the length of the first arm roughly equals the span of the length of the second arm. The first arm and the second arm project away from the crossbeam in the manner of a cantilever. An illiterate U-shaped structure is a U-shaped structure where the span of the length of the first arm does not equal the span of the length of the second arm Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Whiteboard: As used in this disclosure, a whiteboard is a surface that is designed to receive non-permanent markings that can be used for communication or recordation purposes. This definition is explicitly intended to include chalkboards. Whiteboards are also commonly referred to as dry erase boards.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A toy gas station playset comprising a pedestal structure, a plurality of stanchions, and an elevated platform structure;

wherein the plurality of stanchions elevates the elevated platform structure above the pedestal structure;

wherein the toy gas station playset present figurines and puppets;

wherein the toy gas station playset forms a bi-level structure;

wherein the elevated platform structure forms a horizontally oriented surface that receives the figurines and puppets during play activity;

wherein the pedestal structure is a pedestal;

wherein the pedestal structure transfers the loads of the plurality of stanchions and the elevated platform structure to a supporting surface;

wherein the pedestal structure forms a horizontally oriented surface that receives the figurines and puppets during play activity;

wherein the elevated platform structure is a horizontally oriented platform;

wherein the plurality of stanchions combine to attach the elevated platform structure to the pedestal structure;

wherein each of the plurality of stanchions forms a load bearing structure;

wherein each of the plurality of stanchions forms a vertically oriented structure;

wherein the plurality of stanchions elevates the elevated platform structure above the pedestal structure such that the elevated platform structure forms the superior structure of the toy gas station playset;

wherein each of the plurality of stanchions forms a load path that transfers a portion of the load of the elevated platform structure to the pedestal structure;

wherein the pedestal structure comprises a pedestal plate and a first plurality of c-channels;

wherein the pedestal plate is a disk-shaped structure;

wherein the first plurality of c-channels attach to the pedestal plate to form a u-shaped structure;

wherein the first plurality of c-channels elevates the pedestal plate above the supporting surface;

wherein the first plurality of c-channels forms the final link of the load path that transfers the load of the toy gas station playset to the supporting surface.

2. The toy gas station playset according to claim 1 wherein the elevated platform structure comprises a platform plate, a second plurality of c-channels, and a plurality of puppet structures;

wherein the platform plate is a disk-shaped structure;

wherein the platform plate is geometrically similar to the pedestal plate;

wherein a congruent end of the disk structure of the platform plate forms the horizontally oriented surface that receives the figurines and puppets during play activity;

wherein the second plurality of c-channels attaches to the platform plate;

wherein the second plurality of c-channels attach to the platform plate to form a u-shaped structure;

wherein the plurality of puppet structures are physical models of a structure used to emulate the activities of a vehicle.

3. The toy gas station playset according to claim 2 wherein the plurality of stanchions comprises a first stanchion, a second stanchion, a third stanchion, and a fourth stanchion;

wherein the first stanchion forms a portion of the load path the transfers the load of the elevated platform structure to the pedestal structure;

wherein the second stanchion forms a portion of the load path the transfers the load of the elevated platform structure to the pedestal structure;

wherein the third stanchion forms a portion of the load path the transfers the load of the elevated platform structure to the pedestal structure;

wherein the fourth stanchion forms a portion of the load path the transfers the load of the elevated platform structure to the pedestal structure.

4. The toy gas station playset according to claim 3 wherein each of the first plurality of c-channels is formed with a slot;

wherein the slot of each c-channel selected from the first plurality of c-channels runs parallel to the center axis of the selected c-channel;

wherein the span of the length of the inner dimension of the slot of each c-channel selected from the first plurality of c-channels is greater than the span of the length of the thickness of the pedestal plate such that the pedestal plate will insert into the slot of the selected c-channel;

wherein the center dimension of each c-channel selected from the first plurality of c-channels is greater than a dimension selected from the group consisting of: a) the major dimension of the pedestal plate; and, b) the minor dimension of the pedestal plate.

5. The toy gas station playset according to claim 4 wherein the first plurality of c-channels comprises a first c-channel, a second c-channel, and a third c-channel;

wherein the first c-channel forms the first arm of the u-shaped structure formed by the first plurality of c-channels;

wherein the second c-channel forms the crossbeam of the u-shaped structure formed by the first plurality of c-channels;

wherein the third c-channel forms the second arm of the u-shaped structure formed by the first plurality of c-channels.

6. The toy gas station playset according to claim 5 wherein the first c-channel forms a c-channel;

wherein the first c-channel is formed with a slot;

wherein the slot of the first c-channel runs parallel to the center axis of the first c-channel;

wherein the span of the length of the inner dimension of the slot of the first c-channel is greater than the span of the length of the thickness of the pedestal plate such that the pedestal plate inserts into the slot of the first c-channel;

wherein the second c-channel forms a c-channel;

wherein the second c-channel is formed with a slot;

wherein the slot of the second c-channel runs parallel to the center axis of the second c-channel;

wherein the span of the length of the inner dimension of the slot of the second c-channel is greater than the span of the length of the thickness of the pedestal plate such that the pedestal plate inserts into the slot of the second c-channel;

wherein the third c-channel forms a c-channel;

wherein the third c-channel is formed with a slot;

wherein the slot of the third c-channel runs parallel to the center axis of the third c-channel;

wherein the span of the length of the inner dimension of the slot the third c-channel is greater than the span of the length of the thickness of the pedestal plate such that the pedestal plate inserts into the slot of the third c-channel.

7. The toy gas station playset according to claim 6 wherein the platform plate further comprises a ramp structure;

wherein the ramp structure is a ramp;

wherein the ramp structure is an inclined surface that joins the pedestal plate with the platform plate such that the toy gas station playset can emulate the transfer of a vehicle between the pedestal structure and the elevated platform structure.

8. The toy gas station playset according to claim 7 wherein the second plurality of c-channels forms the portion of the load path that transfers the load of the elevated platform structure to the plurality of stanchions;

wherein each of the second plurality of c-channels is formed with a slot;

wherein the slot of each c-channel selected from the second plurality of c-channels runs parallel to the center axis of the selected c-channel;

wherein the span of the length of the inner dimension of the slot of each c-channel selected from the second plurality of c-channels is greater than the span of the length of the thickness of the platform plate such that the platform plate will insert into the slot of the selected c-channel;

wherein the center dimension of each c-channel selected from the second plurality of c-channels is greater that a dimension selected from the group consisting of: a) the major dimension of the platform plate; and, b) the minor dimension of the platform plate.

9. The toy gas station playset according to claim 8 wherein the second plurality of c-channels comprises a fourth c-channel, a fifth c-channel, and a sixth c-channel;

wherein the fourth c-channel forms the first arm of the u-shaped structure formed by the second plurality of c-channels;

wherein the fifth c-channel forms the crossbeam of the u-shaped structure formed by the second plurality of c-channels;

wherein the sixth c-channel forms the second arm of the u-shaped structure formed by the second plurality of c-channels.

10. The toy gas station playset according to claim 9 wherein the fourth c-channel forms a c-channel;

wherein the fourth c-channel is formed with a slot;

wherein the slot of the fourth c-channel runs parallel to the center axis of the fourth c-channel;

wherein the span of the length of the inner dimension of the slot of the fourth c-channel is greater than the span of the length of the thickness of the platform plate such that the platform plate inserts into the slot of the fourth c-channel;

wherein the fifth c-channel forms a c-channel;

wherein the fifth c-channel is formed with a slot;

wherein the slot of the fifth c-channel runs parallel to the center axis of the fifth c-channel;

wherein the span of the length of the inner dimension of the slot of the fifth c-channel is greater than the span of the length of the thickness of the platform plate such that the platform plate inserts into the slot of the fifth c-channel;

wherein the sixth c-channel forms a c-channel;

wherein the sixth c-channel is formed with a slot;

wherein the slot of the sixth c-channel runs parallel to the center axis of the sixth c-channel;

wherein the span of the length of the inner dimension of the slot of the sixth c-channel is greater than the span of the length of the thickness of the platform plate such that the platform plate inserts into the slot of the sixth c-channel.

11. The toy gas station playset according to claim 10 wherein the plurality of puppet structures comprises a storefront and a plurality of pumps;

wherein the storefront is a figurine;

wherein each of the plurality of pumps is a puppet;

wherein the plurality of pumps has the appearance of a structure such that the plurality of pumps emulates a mechanical device known as a gas pump;

wherein the plurality of pumps rests on the superior congruent end of the disk structure of the platform plate.

12. The toy gas station playset according to claim 11 wherein the first stanchion is a vertically oriented structure;

wherein by vertically oriented is meant that the center axis of the first stanchion is aligned with the force of gravity;

wherein the first stanchion attaches to the lateral face of the first c-channel;

wherein the position of the first stanchion is such that the span of the distance from the first stanchion to the free end of the first c-channel is less than the span of the distance from the first stanchion to the fixed end of the first c-channel;

wherein the first stanchion projects away from the center axis of the first c-channel in the superior direction;

wherein the first stanchion removably attaches to the lateral face of the fourth c-channel;

wherein the position of the first stanchion is such that the span of the distance from the first stanchion to the free end of the fourth c-channel is less than the span of the distance from the first stanchion to the fixed end of the fourth c-channel;

wherein the first stanchion projects away from the center axis of the fourth c-channel in the inferior direction.

13. The toy gas station playset according to claim 12 wherein the second stanchion is a vertically oriented structure;

wherein by vertically oriented is meant that the center axis of the second stanchion is aligned with the force of gravity;

wherein the second stanchion attaches to the lateral face of the first c-channel;

wherein the position of the second stanchion is such that the span of the distance from the second stanchion to the fixed end of the first c-channel is less than the span of the distance from the second stanchion to the free end of the first c-channel;

wherein the second stanchion projects away from the center axis of the first c-channel in the superior direction;

wherein the second stanchion removably attaches to the lateral face of the fourth c-channel;

wherein the position of the second stanchion is such that the span of the distance from the second stanchion to the fixed end of the fourth c-channel is less than the span of the distance from the second stanchion to the free end of the fourth c-channel;

wherein the second stanchion projects away from the center axis of the fourth c-channel in the inferior direction.

14. The toy gas station playset according to claim 13 wherein the third stanchion is a vertically oriented structure;

wherein by vertically oriented is meant that the center axis of the third stanchion is aligned with the force of gravity;

wherein the third stanchion attaches to the lateral face of the second c-channel;

wherein the position of the third stanchion is such that the span of the distance from the third stanchion to the fixed end of the second c-channel is less than the span of the distance from the third stanchion to the free end of the second c-channel;

wherein the third stanchion projects away from the center axis of the second c-channel in the superior direction;

wherein the third stanchion removably attaches to the lateral face of the sixth c-channel;

wherein the position of the third stanchion is such that the span of the distance from the third stanchion to the fixed end of the sixth c-channel is less than the span of the distance from the third stanchion to the free end of the sixth c-channel;

wherein the third stanchion projects away from the center axis of the sixth c-channel in the inferior direction.

15. The toy gas station playset according to claim 14 wherein the fourth stanchion is a vertically oriented structure;

wherein by vertically oriented is meant that the center axis of the fourth stanchion is aligned with the force of gravity;

wherein the fourth stanchion attaches to the lateral face of the third stanchion;

wherein the position of the fourth stanchion is such that the span of the distance from the fourth stanchion to the free end of the third stanchion is less than the span of the distance from the fourth stanchion to the fixed end of the third stanchion;

wherein the fourth stanchion projects away from the center axis of the third stanchion in the superior direction;

wherein the fourth stanchion removably attaches to the lateral face of the sixth c-channel;

wherein the position of the fourth stanchion is such that the span of the distance from the fourth stanchion to the free end of the sixth c-channel is less than the span of the distance from the fourth stanchion to the fixed end of the sixth c-channel;

wherein the fourth stanchion projects away from the center axis of the sixth c-channel in the inferior direction.

16. The toy gas station playset according to claim 15 wherein the ramp structure further comprises a cutout plate and a hinge;

wherein the cutout plate is a disk-shaped structure that is cut out of the platform plate of the elevated platform structure;

wherein the hinge is a fastening structure;

wherein the hinge secures the cutout plate to the platform plate such that the cutout plate rotates relative to the platform plate;

wherein the hinge allows for the adjustment of the position of the cutout plate such that the cutout plate forms the inclined surface of the ramp structure;

wherein the position of the cutout plate is formed in the edge of the platform plate that is distal from the fifth c-channel such that the ramp structure is halfway between the fourth c-channel and the sixth c-channel.

17. The toy gas station playset according to claim 16 wherein the pedestal plate further comprises a pedestal chalkboard surface;

wherein the pedestal chalkboard surface is a whiteboard structure formed on the superior surface of the congruent end of the pedestal plate of the pedestal structure;

wherein the pedestal chalkboard surface forms a surface that allows drawing lines that emulate the images commonly used to control vehicle traffic;

wherein the pedestal chalkboard surface is an erasable structure;

wherein the pedestal chalkboard surface is applied to the pedestal plate as a coating of chalkboard paint;

wherein the platform plate further comprises a platform chalkboard surface;

wherein the platform chalkboard surface is a whiteboard structure formed on the superior surface of the congruent end of the platform plate of the pedestal structure;

wherein the platform chalkboard surface forms a surface that allows drawing lines that emulate the images commonly used to control vehicle traffic;

wherein the platform chalkboard surface is an erasable structure;

wherein the platform chalkboard surface is applied to the platform plate as a coating of chalkboard paint.

18. The toy gas station playset according to claim 17 wherein the storefront has the shape of a building;

wherein each of the plurality of pumps is a hollow structure;

wherein each of the plurality of pumps is a fluid impermeable structure;

wherein each of the plurality of pumps is a flexible structure;

wherein the plurality of pumps comprises a first pump and a second pump;

wherein the first pump further comprises a first reservoir and a first nozzle;

wherein the second pump further comprises a second reservoir and a second nozzle.

* * * * *